United States Patent [19]

Landa

[11] 4,413,048

[45] Nov. 1, 1983

[54] DEVELOPING COMPOSITION FOR A LATENT ELECTROSTATIC IMAGE FOR TRANSFER OF THE DEVELOPED IMAGE ACROSS A GAP TO A CARRIER SHEET

[75] Inventor: Benzion Landa, Edmonton, Canada

[73] Assignee: Savin Corporation, Valhalla, N.Y.

[21] Appl. No.: 298,351

[22] Filed: Sep. 1, 1981

[51] Int. Cl.[3] ..... G03G 9/16

[52] U.S. Cl. ..... 430/115; 430/119; 430/137; 430/138

[58] Field of Search ..... 430/115, 117, 118, 119, 430/137, 138

[56] References Cited

U.S. PATENT DOCUMENTS

| | | | |
|---|---|---|---|
| 3,607,342 | 9/1971 | Sato | 430/121 |
| 3,676,215 | 7/1972 | Gundlach | 430/117 |
| 3,766,072 | 10/1973 | Metcalfe et al. | 430/115 |

*Primary Examiner*—John E. Kittle
*Assistant Examiner*—John L. Goodrow
*Attorney, Agent, or Firm*—Shenier & O'Connor

[57] ABSTRACT

A novel liquid composition for developing latent electrostatic images whereby to form a gap between the developed image and the carrier sheet to which the developed image is to be transferred. The composition is such that it contains both charged and uncharged spacer particles. The spacer particles are of larger diameter than the toner particles so as to form a gap between the developed image and the carrier sheet to which they are transferred. The spacer particles, furthermore, have a specific gravity lower than the specific gravity of the carrier liquid, which may be a low-boiling hydrocarbon. This is accomplished by having a gas bubble enclosed in a portion of the material of which the spacer particles are formed, which material is preferably glass. The charged spacer particles may be coated with a polymer of which the toner particles are formed. Both the coated spacer particles and the toner particles bear the same charge. The remainder of the spacer particles are substantially uncharged. The uncharged spacer particles will remain on the background areas of the developed image and prevent the carrier sheet from absorbing liquid present in the developing composition. The charged spacer particles will go to the image areas and become agglomerated with the toner.

13 Claims, 1 Drawing Figure

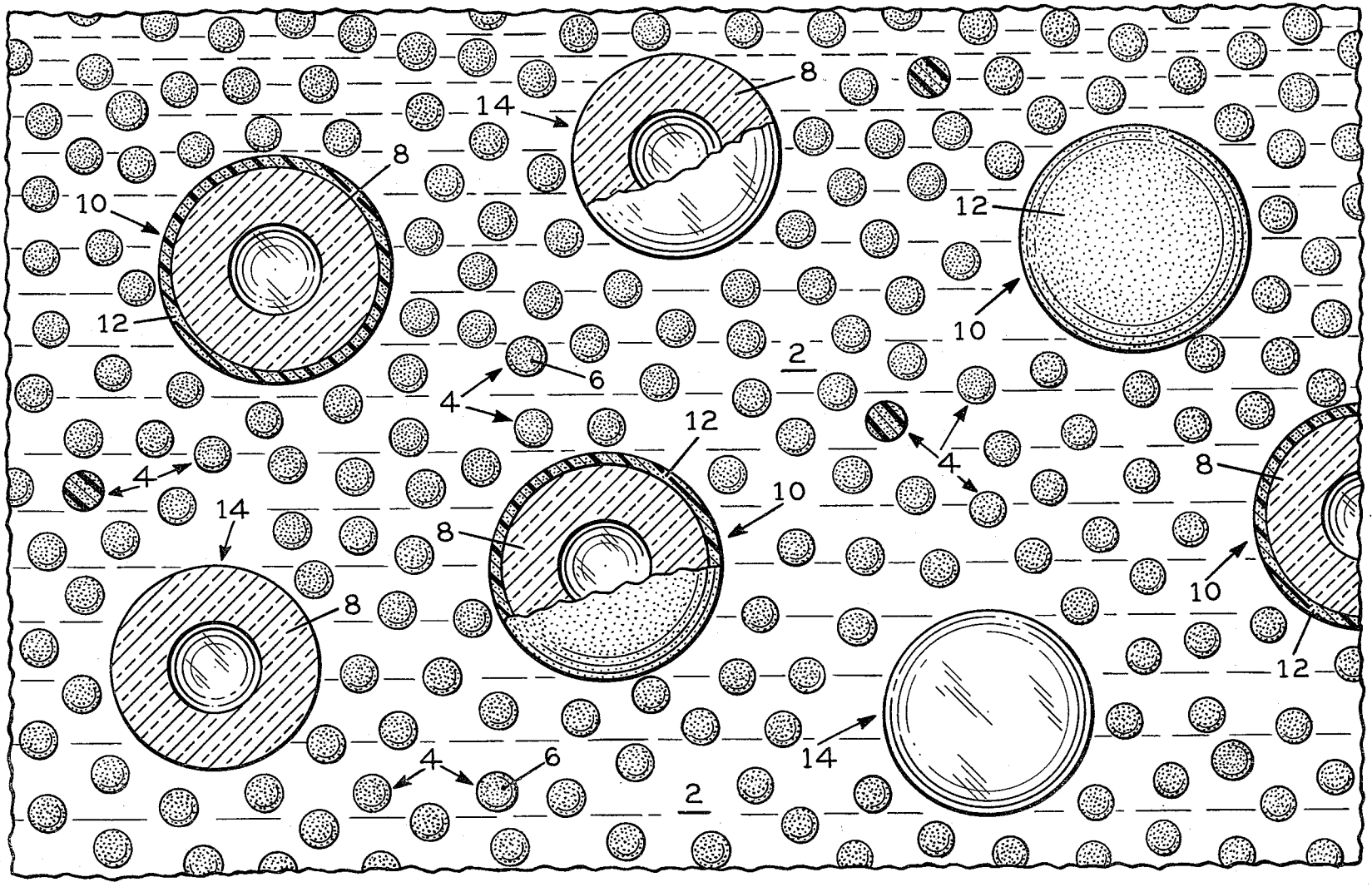
8
10
12
14
2
4
6

DEVELOPING COMPOSITION FOR A LATENT ELECTROSTATIC IMAGE FOR TRANSFER OF THE DEVELOPED IMAGE ACROSS A GAP TO A CARRIER SHEET

CROSS-REFERENCE TO RELATED APPLICATIONS

The present application is related to my application, Ser. No. 149,539, filed May 13, 1980, for "Improved Process and Apparatus for Transferring Developed Electrostatic Images to a Carrier Sheet, Improved Carrier Sheet for Use in the Process and Method of Making the Same," now U.S. Pat. No. 4,364,661; to the application of Benzion Landa and E. Paul Charlap, Ser. No. 249,336, filed Mar. 31, 1981, for "Improved Method and Apparatus for Transferring Electrostatic Images to a Carrier Sheet," now U.S. Pat. No. 4,378,422; to my pending application, Ser. No. 250,720, filed Apr. 3, 1981, for "Composition for Developing Latent Electrostatic Images for Gap Transfer;" and to my pending application, Ser. No. 267,465, filed May 27, 1981, for "Improved Method and Apparatus for Developing Latent Electrostatic Images for Gap Transfer and Improved Composition for Use Therewith".

BACKGROUND OF THE INVENTION

In the copending applications above referred to, it is pointed out that, in all electrophotographic processes of the prior art in which a developed image was transferred to a carrier sheet, such transfer was effected by bringing the carrier sheet into contact with the developed image on the surface bearing the developed image. I will describe my invention in respect of latent images formed on a photoconductor by photography. It is understood, however, that my invention is applicable to an electrostatic image formed on a surface and then transferred to a carrier sheet such as paper.

In the methods of the prior art, liquid developing compositions are the simplest and would normally produce the greatest resolution, since the toner particles of dry toner developers are larger. Unfortunately, in the liquid systems of the prior art, when the developed image is contacted with a carrier sheet for transfer, the image tends to get squashed or flattened. As a consequence, the thickness of the image—that is, the height of the toner on the image thickness—had to be substantially reduced in order to diminish the squashing effect of contact transfer and the resulting loss of resolution or edge sharpness. When the thickness of the image is reduced, there is a lessened quantity of pigment in the image, which produces a low-density image. Three main disadvantages are present in the liquid-toned transfer ("LTT" hereinafter) method. They are as follows:

(a) In the image area, the squashing demands a very thin image which has a low density. This results in requiring a very smooth paper or other medium as a carrier sheet. Rough surfaces may have an amplitude of roughness which is greater than the thickness of the toned image, but the result is that only the tips of the carrier sheet receive the image.

(b) Since the LTT process normally requires wetting of the entire photoconductive surface with a liquid developer, the non-image areas become moistened with the carrier liquid. As a result, there is evaporation of the carrier liquid, which is usually a low-boiling hydrocarbon. This is disadvantageous, from the standpoint of possible pollution in a closed area, and a waste of costly carrier liquid.

(c) When contact transfer is made, dust, fibers, and other contaminants from the carrier sheet are left on the photoconductive surface. These are wiped or washed into the toner liquid remaining in the machine.

All of these disadvantages can be overcome by the gap transfer process—that is, the transfer of a liquid-developed image across a gap to a carrier sheet. First, I am enabled to have a much thicker and pigment-rich—that is, polymer-rich—developed image. Such an image, if allowed to contact the carrier sheet, would be squashed, with the result that resolution and sharpness would be greatly diminished. I am enabled, by gap transfer, to make a very thick developed image and, since I am transferring the image across an air gap, there is virtually no limitation to the thickness of the developed image because of the dimensions of the air gap itself. Of course, there are other constraints, such as the electrostatic fields, the maximum charge the photoconductive surface would hold depending on its dark resistance, the charge to mass ratio, and other considerations.

The maintaining of an air gap by spacing the photoconductive surface from the means for holding the carrier sheet mechanically is so difficult that it is substantially unfeasible. The tolerance of the air gap must be maintained within tens of microns or less. The dimensions of the air gap depend on the tolerance of the photoconductive drum, its concentricity, the uniformity of thickness of the photoconductive surface, the thickness of the paper, and variations in dimension depending on the coefficients of expansion of the materials involved. It will be seen that the essence of my invention is the maintenance of an air gap by dispersed means located between two planes—that is, between the surface of the photoconductor and the surface of the carrier sheet.

In the copending applications above identified, there are disclosed three methods for maintaining an air gap irrespective of variations in tolerance between the paper and the photoconductor. In copending Application Ser. No. 149,539, I have shown means carried by the paper, such as deformations in the paper surface, or plastic bumps, or other means carried by the paper to form the gap. In copending application Ser. No. 249,336, E. Paul Charlap and I have shown means for dusting the developed image with spacer particles or forming deformations on the photoconductive surface to produce the gap. In copending application Ser. No. 250,720, I have shown a composition in which the spacing means comprise spacer particles carried by the developing composition. In copending application Ser. No. 267,465, I show an improvement in which the spacer particles have a surface charge of the same polarity as the charge of the toner particles and a dielectric constant greater than the dielectric constant of the carrier liquid and in which the toner particles have a low charge to mass ratio so as to enable them to form flocs. Since the spacer particles have a surface charge of the same polarity as the charge of the toner particles, they will codeposit with the toner particles dispersed throughout the developing liquid.

In order to prevent the non-image areas from contacting the developer-wetted photoconductor, it is necessary to interpose spacing means between the photoconductor and the non-image areas. To prevent squashing the image, the spacer particles must codeposit with the toner. This means that the spacer particles must bear the same charge as the toner particles. For example, in the case of a selenium-tellurium photoconductor, the corona charge is positive, so the toner particles must be negatively charged. I had no difficulty in having spacer particles codeposit with toner particles. One difficulty which arose, however, was in having the spacer particles deposit on the non-image areas. To do this, one would expect that the spacer particles for the non-image areas should be positively charged. This, however, cannot succeed because positively charged spacer particles would almost instantly be coated with negatively charged toner particles. This produces black dots on the non-image areas. I found the solution to the problem was to have two separate disciplines function in respect of the spacer particles. One discipline has already been described—that is, electrophoresis. The other discipline is to permit polarization of essentially neutral spacer particles or even spacer particles which are slightly charged either positively or negatively. The polarization forces can be orders of magnitude more powerful than surface charge forces. I have described, in copending application Ser. No. 267,465, that I can cause deposition of the spacer particles in the non-image areas by applying a field across the metering gap which removes excess liquid toner from the developed image. The spacer particles respond to the field intensity, since they are made of polarizable material. They preferably have a higher dielectric constant than the carrier medium. Since the particles are polarizable by the field in the metering area, as described in copending application Ser. No. 267,465, they deposit in the non-image areas by a dielectrophoretic force. It will be seen that charged spacer particles will move to the image areas by electrophoresis, while neutral or slightly charged spacer particles will move to the non-image areas by dielectrophoresis following polarization.

Unfortunately, the spacer particles codeposited with the toned image on the carrier sheet form a powdery image. Spacer particles tend to move and, accordingly, scratch the image when they roll about. Furthermore, the number of charged spacer particles which are removed from the dispersion in the liquid toner composition is a function of the overall image area and the density. If there are large black areas in the image, a large amount of charged spacer particles will be removed from the liquid composition. One solution to the problem of eliminating the powdery feel of the developed image, wherein the spacer particles become detached, is to coat that portion of the spacer particles which is to go to the image with toner. Those particles will then form part of the image and give the image a rich feel, almost as if the image were embossed. One difficulty I encountered with this solution of the problem was that the coated spacer particles would settle in a photocopying machine, for example, when the machine was not in use. The ideal spacer particles, both for those which move dielectrophoretically to the non-image areas and those which move to the image areas electrophoretically, would be those which have the same specific gravity, or slightly less specific gravity, than the specific gravity of the dispersing liquid phase of the developing composition. I have solved this problem by making the spacer particles of hollow beads—preferably out of glass—though any beads, such as hollow phenol-condensation product beads, hollow carbon beads, and hollow aluminum beads, all perform successfully. Glass beads have certain advantages—namely:

(a) They are relatively non-reactive;
(b) they are manufactured under known conditions, so I do not have the presence of unknown materials in the toning composition; and
(c) surfactants are not used in their manufacture, so I do not encounter any surface-active materials which would affect the toner.

Since the uncoated beads—that is, the neutral or dielectrophoretic beads—do not go to the image, the depletion of these spacer particles is negligible. The depletion of the coated microsphere of microballoon spacer particles is such that it must be corrected. This is done by adding coated spacer particles, from time to time, to correct the progressive depletion. Feeling the transferred copy is a good indication of the necessity of adding coated spacer particles. When a sufficient population of spacer particles is present, the copy has an embossed feel; that is, the transferred copy feels raised from the carrier such as paper. That is to say, one senses a distinct thickness of the printed area. When this feel diminishes, it is time to add a quantity of coated spacer particles. If there are insuffcent spacer particles present, a contact of the image with the carrier sheet will occur, with the result that the copy will be blurred and the resolution diminished.

FIELD OF THE INVENTION

My invention relates to a developing composition for developing a latent electrostatic image, formed in any manner on an insulating surface or a photoelectric surface, which forms a gap between such surface and a carrier sheet to which the developed image is to be transferred.

DESCRIPTION OF THE PRIOR ART

Machida, in U.S. Pat. No. 3,915,874, discloses a liquid developer for use in developing a latent electrostatic image and then transferring it to a carrier sheet by contact between the carrier sheet and the developed image in which resolution is increased by preventing crushing of the toner particles forming the developed image. He does this by suspending fine particles which are harder than the toner particles throughout the liquid carrier, which is any of the known aliphatic hydrocarbon liquids used in dielectric liquid-carried toner particles forming developing liquids of the prior art. The fine anti-crushing particles employed by Machida are inorganic materials, such as glass beads, zinc oxide, titanium dioxide, silica, and the like. The average fine inorganic particles have a diameter of from 1μ to 15μ. Machida erects a signpost to the art against the instant invention by pointing out that, above a 15μ diameter of the hard, fine particles, there is an increase in white spots which destroy the image and the resolution. There is no disclosure of using spacer particles of such large size as to prevent contact between the carrier sheet and the developed image by forming a gap. The "white spots" mentioned by Machida are "holidays" in the transferred image. The "fine" particles of Machida are equal to or smaller in diameter than the toner particles, so that there is contact between the developed image and the carrier sheet to which the image is being transferred. There is no disclosure of a population of spacer particles which are coated with a toner polymer along with spacer particles which are uncoated. There is no disclosure of spacer particles which are of low specific gravity, achieved by hollow microspheres.

SUMMARY OF THE INVENTION

In general, my invention contemplates the provision of a carrier liquid comprising a low-boiling aliphatic hydrocarbon, such as ISOPAR-G (trademark of Exxon Corporation), as the liquid component of my composition. This is a narrow cut of isoparaffinic hydrocarbons having an initial boiling point of 319° F. and an end point of 345° F. It has a flash point about 100° F. I may use higher-boiling aliphatic hydrocarbon liquids, such as ISOPAR-M (trademark of Exxon Corporation), or light mineral oils, such as "Marcol 52" or "Marcol 62" (trademarks of Humble Oil & Refining Company). I disperse toner particles throughout the liquid carrier. Such particles are known to the prior art and usually comprise pigmented polymers. The toner particles are charged, during the process of preparing them or with a charge director which gives them the desired polarity. If the latent image is formed of negative charges, the toner particles must be positively charged. If the latent image is formed by a positive corona, such as in the case of a selenium-telluride photoconductor, the toner particles will be negatively charged.

In practicing my invention, I employ toner particles which are larger than those normally used, having a diameter of between three and seven microns. This produces a low charge to mass ratio and enables the toner particles to form flocs, or clumps, which are loosely associated but are readily disassociated when the developing liquid is agitated. The quantity of toner particles which I employ may vary between 0.1 percent to 10 percent by weight in respect of the carrier liquid.

OBJECTS OF THE INVENTION

One object of my invention is to provide an improved liquid composition for toning latent electrostatic images, which developed images are adapted to be transferred to a carrier sheet across a gap.

Another object of my invention is to provide a liquid composition adapted to develop a latent electrostatic image for transfer of the developed image across a gap to a carrier sheet, in which the gap is formed by spacer particles disseminated through the liquid along with toner particles, and in which the spacer particles have a specific gravity equal to or lower than the specific gravity of the liquid throughout which they are dispersed.

Still another object of my invention is to provide a liquid composition adapted to develop a latent electrostatic image for transfer of the developed image across a gap to a carrier sheet, in which the gap is formed by spacer particles disseminated through the liquid along with toner particles, and in which the spacer particles are hollow.

A further object of my invention is to provide a liquid composition adapted to develop a latent electrostatic image for transfer of the developed image across a gap to a carrier sheet, in which the gap is formed by spacer particles disseminated through the liquid along with toner particles, and in which a portion of the spacer particles are coated with the composition of which the toner particles are formed.

A still further object of my invention is to provide a liquid composition adapted to develop a latent electrostatic image for transfer of the developed image across a gap to a carrier sheet, in which the gap is formed by spacer particles disseminated through the liquid along with toner particles, and in which there are two species of toner particles, one species of which is coated with the composition of which the toner particles are formed, and the other species of which is uncoated.

An additional object of my invention is to provide a liquid composition adapted to develop a latent electrostatic image for transfer of the developed image across a gap to a carrier sheet, in which the gap is formed by spacer particles disseminated through the liquid along with toner particles, and in which the spacer particles have a diameter great enough to permit a thick deposit of toner particles on the developed image.

Another object of my invention is to provide a liquid composition adapted to develop a latent electrostatic image for transfer of the developed image across a gap to a carrier sheet, in which the gap is formed by spacer particles disseminated through the liquid along with toner particles, and in which the spacer particles have a diameter great enough to permit the thickness of the toner particles on the developed image to be controlled by the magnitude of the corona charge forming the latent image.

Still another object of my invention is to provide a liquid composition adapted to develop a latent electrostatic image for transfer of the developed image across a gap to a carrier sheet, in which the gap is formed by spacer particles disseminated through the liquid along with toner particles, and in which a portion of the spacer particles have a dielectric constant greater than that of the carrier liquid.

A further object of my invention is to provide a liquid composition adapted to develop a latent electrostatic image for transfer of the developed image across a gap to a carrier sheet, in which the gap is formed by spacer particles disseminated through the liquid along with toner particles, and in which a portion of the spacer particles are capable of being polarized.

A still further object of my invention is to provide a liquid composition adapted to develop a latent electrostatic image for transfer of the developed image across a gap to a carrier sheet, in which the gap is formed by spacer particles disseminated through the liquid along with toner particles, and in which a portion of the spacer particles are charged with a polarity having the same sign as the charge of the toner particles.

Other and further objects of my invention will appear from the following description.

BRIEF DESCRIPTION OF THE DRAWING

The accompanying drawing, which forms part of the instant specification and which is to be read in conjunction therewith, is a diagrammatic view, drawn on an enlarged scale with parts in section, of a fragment of my novel developing composition, showing one form of the composition adapted to develop a latent electrostatic image for transfer of the same across a gap to a carrier sheet.

DESCRIPTION OF THE PREFERRED EMBODIMENT

More particularly, referring now to the drawing, the dispersant or liquid component 2 of my developing composition, which acts as a carrier liquid for toner particles 4 and spacer particles 10 and 14, comprises low-boiling aliphatic hydrocarbons such as pointed out above. These liquids are good insulators and have a resistivity of $10^{10}$ ohm-centimeters or greater. The toner particles 4 per se are formed of polymers and resins known to the art, such as polyethylene, polystyrene, amorphous waxes, and various resins. The toner polymers may be pigmented with any desirable pigment, such as submicron carbon black particles 6. Any of the known pigments for coloring polymers, known to the prior art, may be used. The toner particles have a diameter of between three and seven microns, as pointed out in copending application Ser. No. 250,720. These toner particles are larger in size than those customarily used, in order to obtain a low charge to mass ratio. The quantity of toner particles which I employ may vary between 0.1 percent to 10 percent by weight in respect of the carrier liquid. This contrasts with the usual range of toner concentrations of approximately 0.1 percent to 2 percent by weight. Owing to the fact that the developed image never touches the carrier sheet to which the developed image is to be transferred, I am enabled to employ as high as 10 percent by weight of toner particles in respect of the carrier liquid.

There are two species of spacer particles disseminated throughout the carrier liquid. Spacer particle 10 is formed by a balloon or bead 8 containing a gas bubble encapsulated by glass, carbon, phenol-condensation products, aluminum, acrylic resins, or the like. I prefer glass because it is a relatively non-reactive material, and not a polymer which was manufactured under unknown conditions. I am thus assured that leaching of unknown materials, such as surfactants, will not occur in my developing composition. The spacer particles or beads must have a diameter greater than the height of the developed image on the photoconductive surface. This diameter may vary between twenty microns or less and seventy microns. A gap of more than seventy microns is unnecessary for the practice of my invention, though it is to be understood that the invention can be carried on with a larger gap, depending on the potentials involved. Glass beads having a diameter of between twenty and forty microns are manufactured by the Minnesota Mining & Manufacturing Company, of Minneapolis, Minn. Glass beads which I have used are sold by this company's designation "D32/4500." These glass balloons have a specific gravity of 0.32. Another glass balloon sold by the Minnesota Mining & Manufacturing Company is designated "E22" and has a specific gravity of 0.22. These products are glass hollow microspheres and have a wall thickness of about two to three microns. Versar Inc., of Springfield, Virginia, makes "Carbospheres" (trademark). They are carbon microballoons. They have an average diameter of forty microns and may vary in size between five microns and fifty microns in diameter. By classification, any desired diameter may be segregated. The Union Carbide Corporation makes hollow microspheres of phenolic condensation products.

The spacer particles 14 are the same as the basic particles 8 of which spacer particles 10 are formed. The spacer particles 10, however, are provided with a coating 12 formed of the same material as that of which the toner particles 4 are formed. The toner particles 4 and the coating 12 of spacer particles 10 are charged with a charge having a polarity opposite to that of the latent electrostatic image which is to be toned or developed. In order to ensure that the toner particles 4 and the coating 12 have the correct polarity, soluble charge directors known in the art may be added to the liquid component 2. With a selemium photoconductor, an example of charge directors is a composition trademarked "OLOA" and sold by the Oronite Division of the California Chemical Company. Another charge director is a neutral calcium petronate, which is a highly purified, oil-soluble petroleum sulphonate containing calcium, sometimes known as "mahogany soap". Any of the charge directors known to the prior art may be used.

It will be readily appreciated that the coated spacer particles will codeposit with the toner particles during the development of the image. The confection of the toner particles, so that their specific gravity is equal to or less than the specific gravity of the carrier liquid, ensures that the toner particles will not form a sludge or sediment which cannot be readily dispersed, when the machine is placed in operation, by the circulation of the toner liquid from the supply tank to the development zone and back again to the supply tank. I have found no solid material which has mechanical integrity and which has a specific gravity low enough to be able to act as a spacing means in toner dispersions. It appears that almost any solid capable of entraining, encapsulating, or trapping a gas bubble or bubbles can be used as a spacing means if the specific gravity can be lowered. Not only do I want spacing particles which do not settle, but spacing particles which are not so light that they are difficult to redisperse from a floating condition. The specific gravity of ISOPAR-G (trademark of Exxon Corporation) is in the vicinity of 0.75. I have found that, if the gas bubble or bubbles in the spacer particles are such that the specific gravity is less than 0.2, it takes several seconds before the spacer particles redisperse in a copy-machine operation. However, if the specific gravity is increased to over 0.3 or 0.7, the spacer particles redisperse very readily. When the specific gravity of the spacer particles is the same as the specific gravity of the carrier liquid, the optimum condition is reached.

The gas bubble-containing spacer particles which are coated pass to the latent electrostatic image by electrophoresis through the carrier liquid. It is important to prevent contact of the carrier sheet with the non-image areas on the photoconductor or insulating layer bearing the developed electrostatic image. If such contact is made, the carrier sheet will become wet with the carrier liquid, which must then be evaporated. This is counterproductive, if high-speed operation is to be carried on, since an unacceptable quantity of low-boiling carrier liquid will have to be evaporated into the circumambient atmosphere. As pointed out in copending application Ser. No. 267,465, spacer particles my be polarized if they are formed of material having a dielectric constant greater than the dielectric constant of the carrier fluid. The function of the spacer particles 14 is to act as spacer means for the non-image areas of the developed electrostatic image. Obviously, these spacer particles cannot be charged with a polarity opposite to that of the toner particles, since the toner particles would then migrate to such oppositely charged spacer particles.

The uncoated spacer particles 14 must move to the non-image areas by dielectrophoresis. Stated otherwise, these particles must be polarizable. In order to prepare these spacer particles to ensure that they are substantially neutral and do not have a high negative charge or a high positive charge, I soak them in the charge director which I use in the toner composition for a period of time, say, of twenty-four hours. I then remove the beads and wash them with ISOPAR and finally let them dry. Glass seems to have an affinity for the charge director. If I do not pretreat the glass beads with charge director before putting them in my composition, they will tend to draw the charge director from the developing composition. Microballoons made of glass are the most satisfactory, since glass appears readily to adsorb the various charge directors which can be used. I have found that the treatment with charge director constrains the uncoated glass microspheres to behave rather neutrally; that is, they do not deposit in the image areas and they may then develop a very slight positive charge. I have taken a glass slide and soaked half of it in charge director for twenty-four hours and then removed it and thoroughly washed it with ISOPAR, following which I dried it. Upon breathing upon the slide, the condensation of moisture between the two halves was obvious.

The coating or plating of the microspheres with toner composition is easily accomplished. I dissolve about ten percent of the pigmented polymer in ISOPAR at a temperature of 120° C. or higher, depending on the particular polymer used. The microballoons are then disseminated throughout the solution, after which the solution is cooled. The spacer particles act as nuclei upon the surface of which the polymer precipitates when a sufficiently low temperature is reached during the cooling of the solution. The cooled solution may then be added to my novel composition. I have found that the polymer-plated beads raise their specific gravity to about 0.4. At this specific gravity, the coated spacer particles will float, but they do not form a non-dispersable flotsam. It will be observed that the specific gravity of the spacer particles, each of which contains a gas bubble, depends upon the specific gravity of the material of which the spacer particles are made and upon the wall thickness of the hollow spacer particles. Accordingly, by varying the wall thickness of the spacer particles, I may control the specific gravity of the spacer microspheres.

The uncoated or neutral spacer particles, which move dielectrophoretically, may be present in the composition in amounts from 0.1 percent to 10 percent. This amount does not vary greatly, since there is very little depletion of uncoated spacer particles. The coated spacer particles may be present in like quantities, but owing to the fact that these are depleted as a function of the image areas being toned, coated spacer particles must be added, from time to time, as pointed out above.

It will be observed that, depending on the diameter of the spacer particles, I can form a very thick developed image by the simple expedient of raising the potential of the corona charge which forms the latent electrostatic image. In the methods of the prior art, the density of the image cannot be controlled in this manner, since a thick image will form gray or discolored non-image areas when there is contact between the carrier sheet and the developed image. Since in my process of gap transfer there is no physical contact between the paper or other carrier sheet and the developed image, the image can be made very thick, thus producing a dense image. The formation of a thick image is also advantageous in that I may transfer a developed image to a carrier sheet having a very rough surface. One of the disadvantages of the LTT process of the prior art was that it required a carrier sheet of limited roughness, since the image was so thin that all of it would not transfer if the surface were rough. My process and the composition of this invention enable me to transfer the developed image to copy sheets of rough bond paper and even newsprint paper.

It will be seen that I have accomplished the objects of my invention. I have provided a novel composition for toning latent electrostatic images which is adapted to form a gap between the latent electrostatic image and the carrier sheet to which the developed image is to be transferred. I have provided a liquid developing composition containing toner particles and spacer particles of a specific gravity equal to or lower than the specific gravity of the liquid throughout which they are dispersed. My liquid toning composition is provided with spacer particles which contain a gas bubble. My hollow spacer particles are of two species, one of which is coated with toner material and the other of which is neutral. The coated spacer particles move with the toner particles to develop the latent electrostatic image, while the uncoated spacer particles move dielectrophoretically to prevent the non-image areas from contacting the carrier sheet. I am enabled to form a thick deposit of toner particles on the developed image, which enables me to transfer the developed image to a carrier sheet having a rough surface. I may control the density of the developed image by controlling the magnitude of the corona charge forming the latent electrostatic image. My novel composition enables copies of originals to be made with increased resolution and with a minified wetting of the carrier sheet with the carrier liquid.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A composition for developing latent electrostatic images including in combination a major portion of a normally fluid insulating liquid, a minor portion of charged resinous toner particles, and a minor portion of nonconductive spacer particles, each of said spacer particles having a portion enclosing a gas bubble, and each of said spacer particles having a diameter larger than the diameter of said toner particles.

2. A composition for developing latent electrostatic images including in combination a major portion of a normally fluid insulating liquid, a minor portion of charged pigmented polymer toner particles, and a minor portion of nonconductive spacer particles, each of said spacer particles having a hollow portion, and each of said spacer particles having a diameter larger than the diameter of said toner particles.

3. A composition for developing latent electrostatic images including in combination a major portion of a normally fluid insulating liquid, a minor portion of charged pigmented polymer toner particles, and a minor portion of nonconductive spacer particles, each of said spacer particles having a hollow portion, each of said spacer particles having a diameter larger than the diameter of said toner particles, and a portion of said spacer particles being coated with a polymer.

4. A composition for developing latent electrostatic images including in combination a major portion of a normally fluid insulating liquid, a minor portion of charged pigmented polymer toner particles, and a minor portion of nonconductive spacer particles, each of said spacer particles having a hollow portion, each of said spacer particles having a diameter larger than the diameter of said toner particles, and each of said spacer particles having a specific gravity of less than the specific gravity of said insulating liquid.

5. A composition for developing latent electrostatic images including in combination a major portion of a normally fluid insulating liquid, a minor portion of charged resinous toner particles, and a minor portion of nonconductive spacer particles, each of said spacer particles having a portion enclosing a gas bubble, each of said spacer particles having a diameter larger than the diameter of said toner particles, and a portion of said spacer particles having a dielectric constant greater than the dielectric constant of said liquid.

6. A composition for developing latent electrostatic images including in combination a major portion of a normally fluid insulating liquid, a minor portion of charged resinous toner particles, and a minor portion of nonconductive spacer particles, each of said spacer particles having a portion enclosing a gas bubble, each of said spacer particles having a diameter larger than the diameter of said toner particles, and a portion of said spacer particles having a surface charge of a polarity of the same sign as the charge of said toner particles.

7. A composition for developing latent electrostatic images including in combination a major portion of a normally fluid insulating liquid, a minor portion of charged resinous toner particles, and a minor portion of nonconductive spacer particles, each of said spacer particles having a portion enclosing a gas bubble, each of said spacer particles having a diameter larger than the diameter of said toner particles, a portion of said spacer particles having a surface charge of a polarity of the same sign as the charge of said toner particles, and a portion of said spacer particles having a substantially neutral charge.

8. A composition for developing latent electrostatic images including in combination a major portion of a normally fluid insulating liquid, a minor portion of charged resinous toner particles, and a minor portion of nonconductive spacer particles, each of said spacer particles having a portion enclosing a gas bubble, each of said spacer particles having a diameter larger than the diameter of said toner particles, and said spacer particles being present in an amount by weight of between 0.1 percent and 20 percent in respect of the weight of the insulating liquid.

9. A composition for developing latent electrostatic images including in combination a major portion of a normally fluid insulating liquid, a minor portion of charged resinous toner particles, said toner particles being present in the amount of 0.1 percent to 10 percent by weight in respect of the insulating liquid, and a minor portion of nonconductive spacer particles, each of said spacer particles having a portion enclosing a gas bubble, each of said spacer particles having a diameter larger than the diameter of said toner particles, a portion of said spacer particles being coated with a resin and bearing a charge of the same sign as the charge of said toner particles, said coated spacer particles being present in the amount of 0.1 percent to 10 percent by weight in respect of said insulating liquid, and the remaining portion of said spacer particles being substantially uncharged and being present in the amount of 0.1 percent to 10 percent by weight in respect of said insulating liquid.

10. A composition for developing latent electrostatic images including in combination a major portion of a normally fluid insulating liquid, a minor portion of charged resinous toner particles having a diameter of between three microns and seven microns, and a minor portion of nonconductive spacer particles, each of said spacer particles having a portion enclosing a gas bubble, and each of said spacer particles having a diameter of between twenty microns and seventy microns.

11. A composition for developing latent electrostatic images including in combination a major portion of a normally fluid insulating liquid, a minor portion of charged resinous toner particles having a diameter of between three microns and seven microns, and a minor portion of spacer particles, each of said spacer particles having a portion enclosing a gas bubble, each of said spacer particles having a diameter of between twenty microns and seventy microns, each of said spacer particles having a specific gravity of approximately half the specific gravity of said insulating liquid, a portion of said spacer particles being coated with a resin and bearing a charge of the same sign as the charge of said toner particles, and another portion of said spacer particles being substantially uncharged and subject to being polarized by an electric field.

12. A composition for developing latent electrostatic images including in combination a major portion of a normally fluid low-boiling hydrocarbon liquid, from 0.1 percent to 10 percent by weight in respect of said liquid of charged pigmented polymer toner particles, said toner particles having a diameter of between three microns and seven microns, a minor portion of inert solid microspheres forming spacer particles, each of said spacer particles containing a gas bubble and having a diameter of between twenty microns and seventy microns, between 0.1 percent and 10 percent by weight in respect of said liquid of said spacer particles being coated with a pigmented polymer and bearing a charge having the same sign as the charge of said toner particles, from 0.1 percent to 10 percent by weight in respect of said liquid of said spacer particles being substantially uncharged, and said spacer particles having a specific gravity of between 0.3 and 0.7.

13. A composition for developing latent electrostatic images including in combination a major portion of a normally fluid low-boiling hydrocarbon liquid, from 0.1 percent to 10 percent by weight in respect of said liquid of charged pigmented polymer toner particles, said toner particles having a diameter of between three microns and seven microns, a minor portion of glass microspheres forming spacer particles, each of said spacer particles containing a gas bubble and having a diameter of between twenty microns and seventy microns, between 0.1 percent and 10 percent by weight in respect of said liquid of said spacer particles being coated with a pigmented polymer and bearing a charge having the same sign as the charge of said toner particles, from 0.1 percent to 10 percent by weight in respect of said liquid of said spacer particles being substantially uncharged and said spacer particles having a specific gravity of between 0.3 and 0.7.

* * * * *